US007549526B2

(12) United States Patent
Ohtomo

(10) Patent No.: US 7,549,526 B2
(45) Date of Patent: Jun. 23, 2009

(54) COIN IDENTIFYING SENSOR AND A COIN SELECTOR WITH COIN IDENTIFYING APPARATUS

(75) Inventor: Hiroshi Ohtomo, Saitama (JP)

(73) Assignee: Asahi Seiko Co., Ltd., Saitama-ken (JP)

( * ) Notice: Subject to any disclaimer, the term of this patent is extended or adjusted under 35 U.S.C. 154(b) by 98 days.

(21) Appl. No.: 11/769,173

(22) Filed: Jun. 27, 2007

(65) Prior Publication Data

US 2008/0000751 A1 Jan. 3, 2008

(30) Foreign Application Priority Data

Jun. 30, 2006 (JP) ..... 2006-181903

(51) Int. Cl.
*G07D 7/00* (2006.01)
*H01F 27/28* (2006.01)

(52) U.S. Cl. ..... 194/302; 194/318; 336/225

(58) Field of Classification Search ..... 194/302, 194/303, 317, 318; 336/225, 226
See application file for complete search history.

(56) References Cited

U.S. PATENT DOCUMENTS 6,667,615 B2 * 12/2003 Aruga et al. ..... 324/232
6,668,999 B2 * 12/2003 Ohtomo ..... 194/318

FOREIGN PATENT DOCUMENTS

JP 2002-074444 3/2002

* cited by examiner

*Primary Examiner*—Patrick Mackey
*Assistant Examiner*—Mark Beauchaine
(74) *Attorney, Agent, or Firm*—McGlew and Tuttle, P.C.

(57) ABSTRACT

A coin identifying sensor and a coin identifying apparatus has coin detecting sections (25X and 25Z) that are formed by relatively disposing a group of coin identifying sensors (21A, 21B, 21C and 21D) with each group provided with three aligned and integrated coin sensors. Each, of the sensors has a core wound with a coil. The sensors are disposed in a coin path in a direction crossing a movement direction of a coin. The first and second coin detecting sections are sequentially disposed on a coin path (4) to determine whether a coin is real or not using detection data of diameter, material and thickness of the coin based upon detection outputs sequentially obtained from the coin detecting sections.

13 Claims, 11 Drawing Sheets

COIN IDENTIFYING SENSOR AND A COIN SELECTOR WITH COIN IDENTIFYING APPARATUS

CROSS REFERENCE TO RELATED APPLICATIONS

This application claims the benefit of priority under 35 U.S.C. § 119 of Japan Patent Application JP 2006-181903 filed Jun. 30, 2006, the entire contents of which are incorporated herein by reference.

FIELD OF THE INVENTION

The present invention relates to a coin identifying sensor for discriminating a disk-shaped coin currency, a disk-shaped medal used for a game machine, a token, or the like, and a coin selector coin identifying apparatus comprising the coin identifying sensor. The present invention particularly relates to a coin identifying apparatus for electrically detecting a size or material of a coin or disk for discrimination. Specifically, the present invention relates to a coin identifying apparatus of a coin selector preferable to be incorporated in equipment activated by a coin or medal dropped in, such as various types of automatic vending machines, change machines or game machines. The term "coin" used in this text embraces a coin which is currency, a medal or token for a game machine, a token as money or discs and things of a like kind.

BACKGROUND OF THE INVENTION

A conventional apparatus has been known for electrically discriminating a disk such as a coin, which utilizes the fact that a disk dropped in changes a magnetic flux generated by a coil. There have been various kinds of such electronic discriminating apparatuses.

For example, a conventional design employs a discriminating apparatus having a configuration in which a plurality of coin sensors (hereinafter "sensors"), each of which includes a pair of coils attached opposite to each other on the opposite side walls in a thickness direction, are disposed in a path where a disk such as a coin drops due to its own weight. A voltage signal variation of each sensor is detected that is caused by a magnetic flux variation generated by the disk, such as a coin moving in the course of dropping and passing between the coils of each sensor to determine whether the disk is real or not (JP-A-2002-74444 (pp. 3 to 5, FIGS. 1 to 23)). In this case, the sensors at both right and left ends discriminate a size of the coin, namely, determine whether or not the coin has a predetermined diameter, and the sensor at a center detects a material or thickness thereof.

Here, in a case of the discriminating apparatus, the sensors must be disposed on a side wall and the other side wall opposite thereto in the path, respectively, and further, there is some complication during assembly because of a physical limitation that requires sensors to be disposed on a narrow coin path of a coin selector, which consequently poses a problem with assembly accuracy. Particularly, if the center of a coil deviates in position during the sensor assembly, discrimination performance is adversely influenced, and care must be therefore given to the assembly. Such a physical limitation as to a sensor position in space makes it difficult to dispose many sensors, to improve selection accuracy. Further this limits the ability to shrink the size of the apparatus. There is also a problem in which the cost of manufacture, management and the like is high because of parts management issues associated with handling many small sensors.

When a coin is detected by the plurality of coin sensors disposed on the sides of the coin path along a diameter direction of a coin, the sensor positioned at a center of the coin detects a material or thickness of the coin using a peak value of a detection output of the sensor. However, when coins are sequentially dropped in, the coins are lined up end to end and pass through the sensor, so that the sensor is influenced by both preceding and following coins lined up end to end, which results in the appearance of a plurality of peak values in a detection output of the sensor, or sequential appearance of approximate peak values in a detection output. Therefore, in the signal output, there is the difficulty of clearly discriminating preceding and following coins.

SUMMARY OF THE INVENTION

The present invention has been made in view of these circumstances, and a first object thereof is to provide a coin identifying sensor and a coin identifying apparatus which are improved to be capable of contributing to the improvement of discrimination accuracy.

A second object thereof is to provide a coin identifying sensor and a coin identifying apparatus which can contribute to manufacturing a completed product with high quality at low cost.

A third object thereof is to provide a coin identifying apparatus which can reliably select coins one by one that have been sequentially dropped in.

A fourth object thereof is to provide a coin identifying sensor and a coin identifying apparatus which are improved in assembly performance and can be manufactured easily.

The present invention is a coin identifying sensor in which a plurality of sensors, each having a core wound with a coil, are integrated in a row and fixedly disposed.

According to this configuration, the coin identifying sensor has a plurality of sensors for coin detection that are aligned and fixed integrally. When two units of the unitized coin identifying sensors are prepared and disposed symmetrically with respect to a coin path, the plurality of sensors are all completely coincident with each other without positional deviation. Therefore, a coin identifying apparatus can be provided which can maintain higher coin identification accuracy compared to a conventional apparatus with a possible positional deviation where identifying sensors are individually disposed. Further, the apparatus is improved in assembly performance and can be manufactured easily.

The coin identifying sensors according to the present invention are provided adjacent to a coin path of a coin selector, and disposed in a direction crossing a movement direction of a coin. The coin identifying sensor has three sensors aligned laterally, with each of two end sensors of these positioned corresponding to pass-through positions for both ends of a coin passing through the coin path and a remaining central sensor positioned corresponding to a pass-through position for the center of the coin. That is, the three sensors are provided in advance in such a positional relationship that the both ends and the center of a coin to be detected pass through the three sensors, respectively. Therefore, a diameter of a coin can be detected by the sensors at both ends, and data on the thickness or material of the coin can be detected by the sensor at a center. Further, even when a coin with a different diameter is to be detected, a change of the sensor positions according to the diameter of the coin can be made by a mere design change, so that a coin identifying sensor can be easily provided which can always deliver a good selection performance for the coin to be detected. Further, since the three sensors are provided integrally in a unitized coin identifying sensor, wiring to a discriminating circuit positioned on a downstream stage from the identifying sensor is less complicated compared to a conventional identifying apparatus in which sensors are individually disposed. This offers an advantage that wiring work can be performed easily. Further, according to the configuration of the present invention, three integrated sensors allow the downsizing of an apparatus and make it possible to produce a compact coin selector, leading to a decrease in manufacturing cost.

The coin identifying sensor according to the present invention includes a core main body in which three rectangular cores aligned at intervals are formed in a protruding condition and three rectangular coils wound around the cores respectively.

According to this configuration, since the three rectangular cores are integrally provided on the core main body in a protruding condition, a coin identifying sensor comprising three sensors can be easily formed by mounting coils on the cores respectively in a rectangular form. Even if there is any difference in size or in pass-through position in a coin path among coins, the coin identifying sensor outputs a uniform detection output and delivers a good detection performance because the sensor is composed of rectangular cores and the coils which do not vary a relative area of a sensor to a coin.

Despite the configuration composed of three coils, the object to be mounted is one core main body, so that work is focused on this one main body. Since the core main body becomes a unitized body with a moderate size in which the coils are set in without any possibility of dropping out of the cores once the coils are mounted, such a complication in assembly is eliminated as a conventional apparatus in which small difficult-to-handle coils and sensors are individually mounted on a coin path. Thereby, such an actual benefit as improvement of parts management is also obtained.

The present invention is a coin identifying apparatus of a coin selector, in which the two rectangular coin identifying sensors are disposed opposite to each other across the coin path in the direction crossing a movement direction of a coin to form a coin detecting section, and a coin is detected at the coin detecting section. According to this configuration, the rectangular coin identifying sensors can be attached in a stable manner in contact with the side of the coin path uniformly and entirely. Since the coin detecting section is formed by the two coin identifying sensors opposite to each other, to detect a coin passing through therebetween, a diameter, material, thickness or the like of a coin can be well detected.

Further, the present invention is the coin identifying apparatus of a coin selector, in which a first coin detecting section and a second coin detecting section each comprising a pair of the coin identifying sensors sandwiching the coin path are disposed sequentially on the coin path in the movement direction of a coin. By disposing two pair of coin identifying sensors opposing each other across the coin path, a coin selector can be easily provided in which the first coin detecting section is disposed at an upstream position of the coin path and the second coin detecting section is disposed at a downstream position thereof. Since sensors positioned at both ends of the first and second coin detecting sections face each other at pass-through positions for both ends of a diameter of a coin passing through the coin path respectively, a diameter of a coin can be detected. Since sensors positioned at a center thereof faces each other at a pass-through position for the center of a coin passing through the coin path, a material or thickness thereof can be detected. Further, since whether a coin is real or not is determined based upon detection outputs generated by the first and second coin detecting sections in this order, even if an illegal buying action or a malicious mischief is attempted by dropping a coin hung on a string or the like and moving the same up and down, the coin is detected by the detection outputs generated by the second and first coin detecting sections in this order, which is different from the above, thereby such an illegal operation can be found out. Therefore, in this case, such an illegal operation or a malicious mischief can be prevented by performing a procedure such as using the detection outputs different in output order for determination of rejection.

Further, the present invention relates to the coin identifying apparatus of a coin selector, in which the first and second coin detecting sections are disposed in a vertical relationship on the coin path formed vertically. In this case, detection for coin discrimination is performed by the first and second coin detecting sections disposed in a vertical relationship on the vertical coin path, as in the above case. The diameter of a coin is detected by right and left sensors of the first and second coin detecting sections facing each other at pass-through positions for right and left ends of a coin passing through the coin path, and a material and thickness sensor of the coin are detected by central sensors thereof facing each other at a pass-through position for the center of the coin, and then whether the coin is real or not is determined by a downstream discriminating circuit based upon the detection outputs of these detections. As in the above case, an illegal operation or malicious mischief attempted by using a coin hung on a string or the like can be prevented by monitoring whether or not the detection outputs are generated by the upstream and downstream coin detecting sections in this order.

A further aspect of the present invention involves the coin identifying sensor of a coin selector, in which the first coin detecting section has a first diameter detection sensor which detects a diameter of a coin by both end sensors positioned corresponding to the pass-through positions for both ends of a coin and a material sensor for material detection positioned corresponding to the pass-through position for the center of the coin, while the second coin detecting section has a second diameter detection sensor which detects a diameter of the coin by both end sensors positioned corresponding to the pass-through positions for the right and left ends of the coin and a thickness sensor for coin thickness detection positioned corresponding to the pass-through position for the center of the coin. According to this configuration, since the two coin detecting sections are disposed sequentially along a movement pathway of a coin or along a vertical path and roles are divided between central sensors of the two coin detecting sections such that either one thereof is exclusively used for material detection and the other is for thickness detection, the wiring of circuits forming the whole discriminating apparatus or the like can be made simple.

A further aspect of the present invention is the coin identifying apparatus having a discriminating means in which a detection output of the material sensor at a point of output of a peak value of the first diameter detection sensor is picked up and obtained as material determination value data, a detection output of the thickness sensor at a point of output of a peak value of the second diameter detection sensor is picked up and obtained as thickness determination value data, and the coin is detected based upon the diameter, material and thickness data. By using a detection system in which material data is picked up at a point of the peak value of the first diameter detection sensor and then thickness data is picked up at a point of the peak value of the second diameter detection sensor, the most effective material/thickness data can be detected reliably and in a stable manner, which is the data obtained when the center of a coin and the material/thickness detection sensor correspond to each other. Therefore, even if coins are sequentially dropped in as well as a single coin is dropped in, individual data of the coins can be obtained reliably, so that a discriminating process can be executed with high accuracy and coin processing can be performed speedily. Therefore, when the present coin selector is equipped in a game machine or the like, the availability of the game machine or the like can be increased.

Four pairs of identifying sensors may be prepared, each having a configuration in which three sensors are provided. The sensors each have a core wound with a coil integrated laterally in a row and fixedly disposed. Two of the four pairs of coin identifying sensors are disposed opposite to each other across a coin path in a direction crossing a movement direction of a coin to configure and dispose first and second coin detecting sections in a vertical relationship on the coin path. The present invention is a coin identifying apparatus of a coin selector, in which the first coin detecting section has a first diameter detection sensor which detects a diameter of a coin by both end sensors positioned corresponding to pass-through positions for both ends of a coin and a material sensor for material detection positioned corresponding to a pass-through position for the center of the coin, while the second coin detecting section has a second diameter detection sensor which detects a diameter of a coin by both end sensors positioned corresponding to pass-through positions of the right and left end portions of a coin and a thickness sensor for coin thickness detection positioned corresponding to a pass-through position for the center of the coin. The coin identifying apparatus of the coin selector of the present invention provides a detection output of the material sensor at a point of output of a peak value of diameter data of the first diameter detection sensor that is picked up and obtained as material determination value data. A detection output of the thickness sensor at a point of output of a peak value of diameter data of the second diameter detection sensor is picked up and obtained as thickness determination value data. Whether the coin is real or not is determined based upon these diameter, material and thickness data.

Hereinafter, an embodiment of the present invention will be explained with reference to the drawings. The disks are referred to as coins for explanation purposes, and the term "coin" is intended to includes coin currency, a medal for a game machine, a token and the like. Further, a case in which the present invention is applied to a coin path through which a coin drops due to its own weight will be explained as an embodiment. It will be obvious that the present invention can be applied to a coin path which is inclined downward at an appropriate angle and on which a coin moves in a rolling manner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
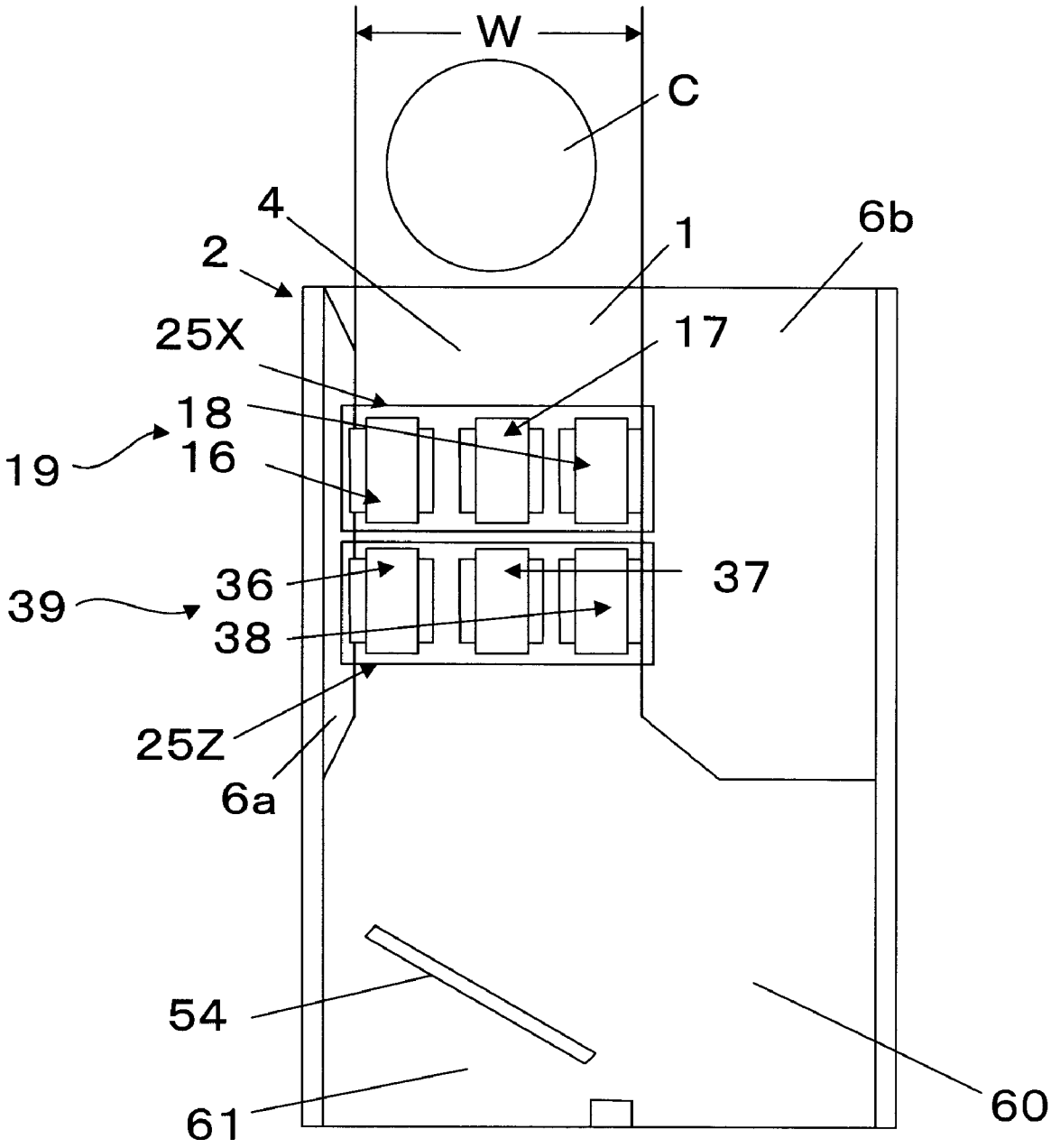
FIG. 1 is a schematic view of a coin selector provided with a coin detecting apparatus according to the present invention.

Referring to the drawings in particular, a coin selector main body 2 has a coin receiving opening 1 on its upper portion. The coin receiving opening 1 communicates with a vertical coin path 4 formed inside the coin selector main body 2. A coin C entering at the receiving opening drops directly below through the coin path 4 due to its own weight. The coin path 4 is composed of front and back side plates 5*a* and 5*b* disposed opposite to each other at an interval in a thickness direction of the coin C and right and left vertical walls 6*a* and 6*b* disposed away from each other in a radial direction of the coin C between the side plates 5*a* and 5*b* (see FIG. 14). Therefore, the coin path 4 has a tunnel-like path structure which is defined by the front and back side plates 5*a* and 5*b* and the right and left vertical walls 6*a* and 6*b* to be rectangular in cross section and which extends in a vertical direction.

An interval between the right and left vertical walls 6*a* and 6*b* is set to be slightly larger than a maximum diameter of a coin C to be used, in order to be capable of receiving several types of coins. An interval between the front and back side plates 5*a* and 5*b* is slightly larger than a maximum thickness of the coin C to be used. Here, the right and left vertical walls 6*a* and 6*b* have a structure movable in a widthwise (W) direction of the coin path 4. Though not illustrated, a means for making the vertical walls 6*a* and 6*b* movable can be achieved by, for example, a mechanism of connecting the vertical walls movably to a movement adjusting member which can be operated externally, or the like. The movement adjusting member can be operated to move the vertical walls 6*a* and 6*b* in parallel such that they approach each other or move away from each other in a radial direction of a coin between the side plates 5*a* and 5*b*. Thereby, in response to plural types of coins different in size, the coin path 4 can be freely adjusted and set to have a path width W which is slightly larger than a diameter of a maximum coin to be used. By making the vertical walls 6*a* and 6*b* movable to adjust the coin path width W, a coin dropped in is caused to pass through a center of the coin path 4, so that detection accuracy is improved to make a reliable discrimination by a sensor.

Figure 2:
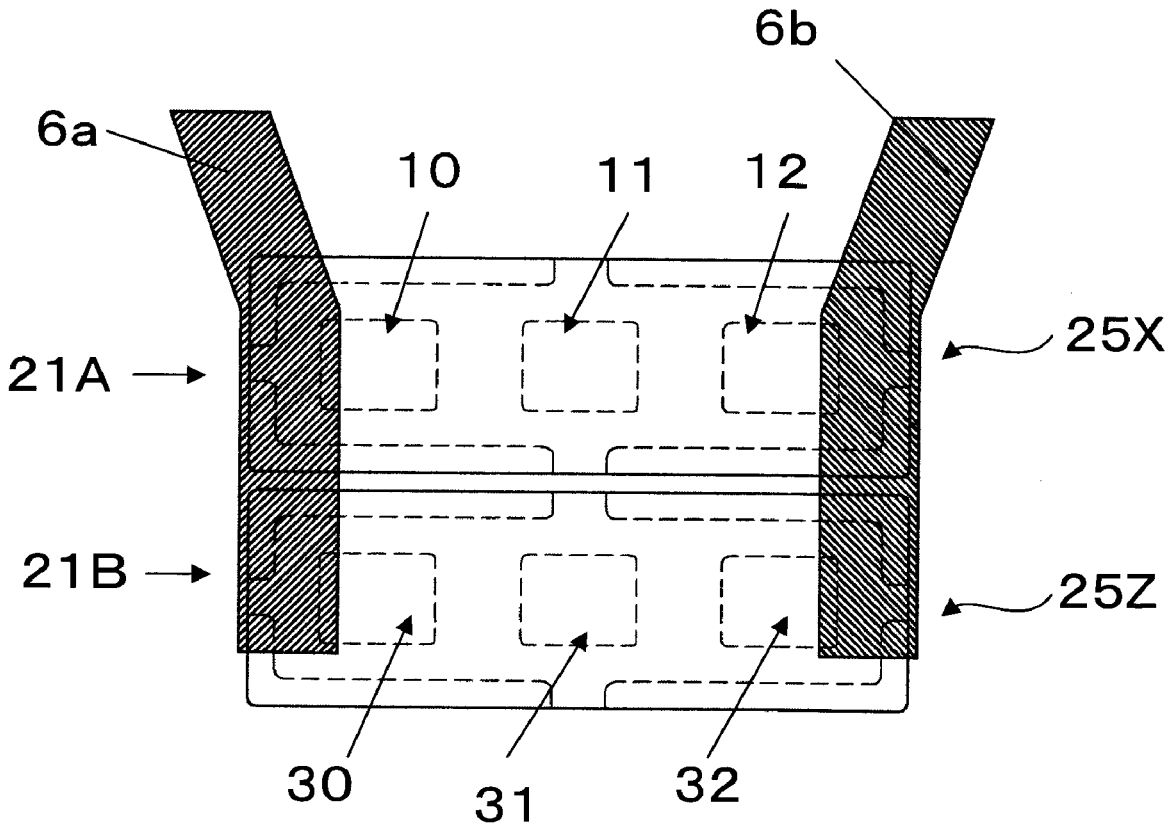
FIG. 2 is a main element structural diagram of the detecting apparatus composed of integrated sensor bodies according to the present invention.
Figure 3:
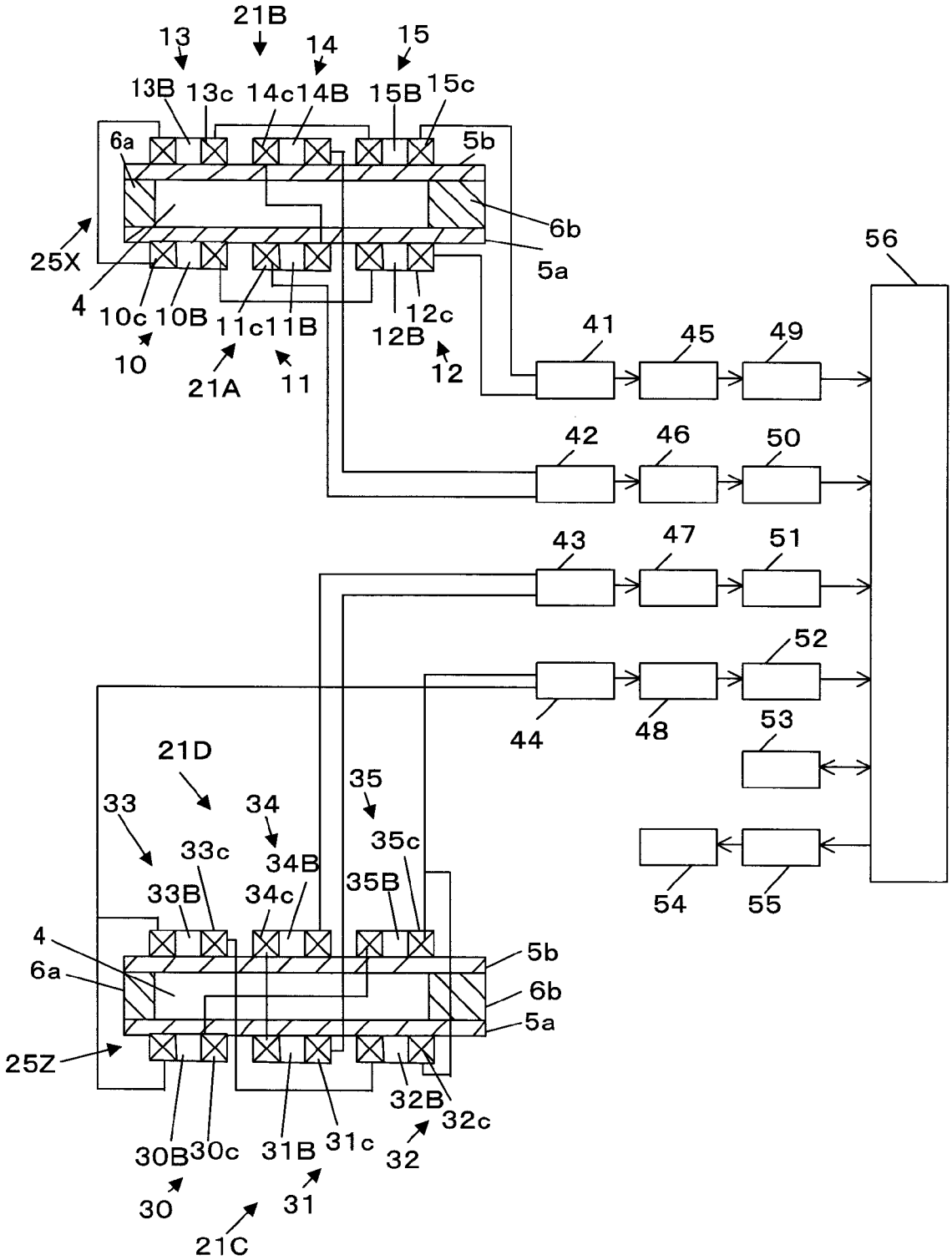
FIG. 3 is a block diagram of a coin detecting circuit.

As shown in FIGS. 1, 2 and 3, three sensors 10, 11 and 12 are disposed on the front side plate 5*a* of the coin path 4 at predetermined intervals in the widthwise (W) direction of the coin path 4. Further, three sensors 13, 14 and 15 are also disposed on the back side plate 5*b* of the coin path 4 similarly at predetermined intervals. Therefore, the three sensors 10, 11 and 12 and the three sensors 13, 14 and 15 are symmetrically positioned across the coin path 4. As shown in FIG. 3, the sensors 10 and 13 which are positioned on the front and back of the coin path 4 respectively are paired to form a left end sensor 16, and as shown in FIG. 1, the left end sensor 16 is positioned at a left end of the coin path 4. Similarly, the sensors 12 and 15 are paired to form a right end sensor 18, and as shown in FIG. 1, the right end sensor 18 is positioned at a right end of the coin path 4. The sensor 11 and the sensor 14 are paired to form a central sensor 17, and similarly the central sensor 17 is positioned at a center of the coin path 4. The left end sensor 16 and the right end sensor 18 form a diameter detection sensor which detects a diameter of a coin. The central sensor 17 form a material sensor which detects a material of a coin.

Next, the structures of respective sensors will be explained with reference to FIGS. 4 to 8. Since all the sensors have a similar structure, the sensors 10, 11 and 12 disposed on the front side plate 5*a* will be explained as representations, for example. Each of the sensors 10, 11 and 12 has a core 10B, 11B and 12B, respectively. Sensor coils 10*c*, 11*c* and 12*c* are wound around these cores 10B, 11B and 12B, respectively. A magnetic flux is generated by applying current to the sensor coils 10*c*, 11*c* and 12*c*. Similarly, the sensors 13, 14 and 15, disposed on the back side plate 5*b*, have cores 13B, 14B and 15B and sensor coils 13*c*, 14*c* and 15*c*, respectively. When current is applied to the respective sensor coils 10*c*, 11*c*, 12*c*, 13*c*, 14*c* and 15*c*, a magnetic flux is generated in the coin path 4. Since a flux content varies when a coin passing through cuts the magnetic flux, a coin is sensed by detecting a voltage value according to the varied flux content from the sensor coils.

Figure 4:
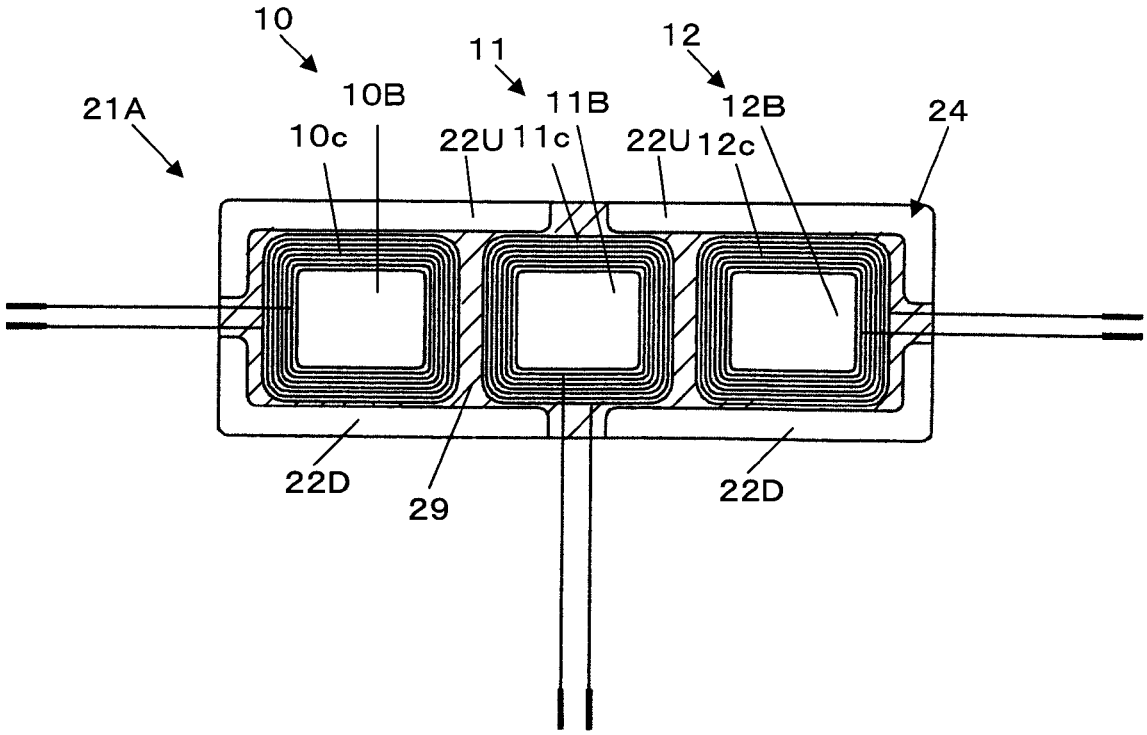
FIG. 4 is a partial diagram showing aspects of the configuration of the integrated sensor body.
Figure 5:
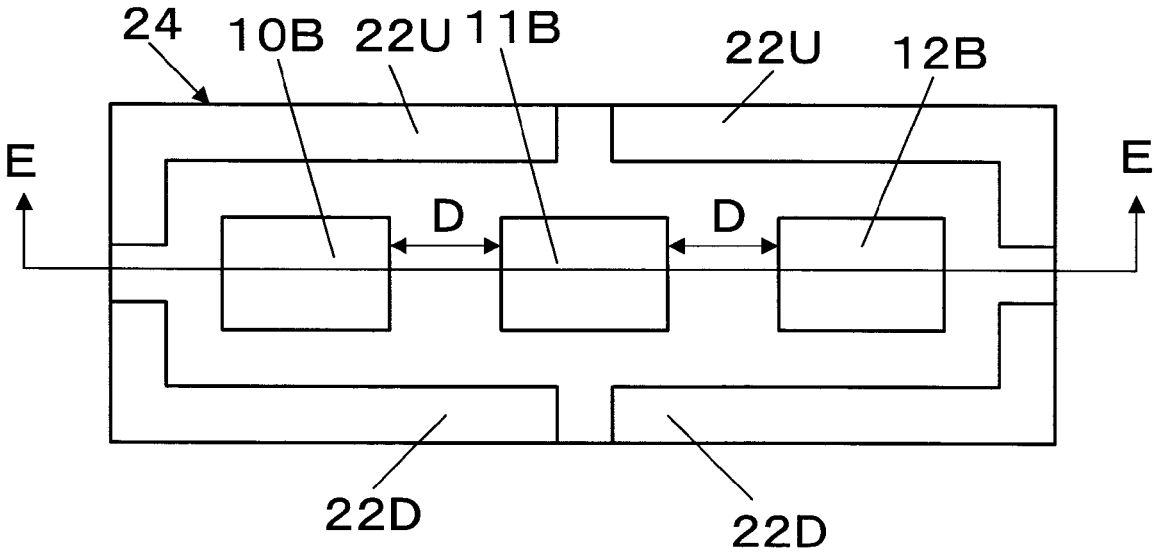
FIG. 5 is a partial diagram showing aspects of the configuration of the integrated sensor body.
Figure 6:
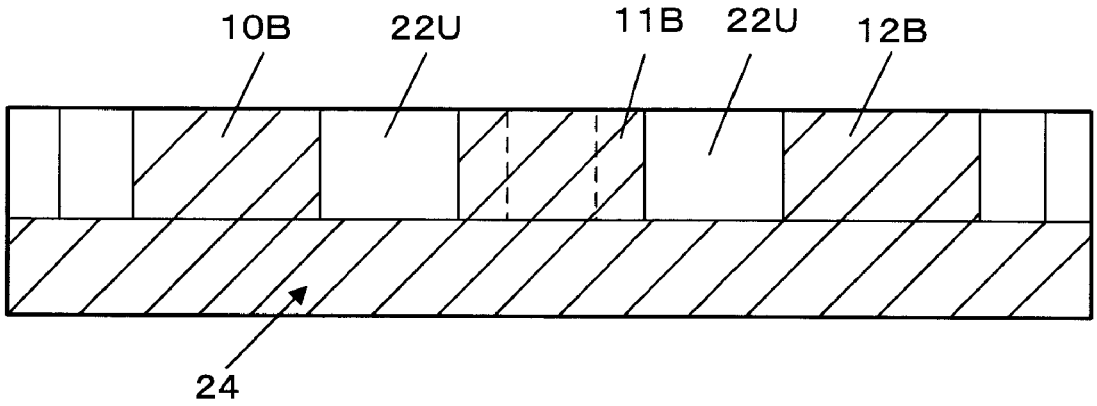
FIG. 6 is a partial diagram showing aspects of the configuration of the integrated sensor body.
Figure 7:
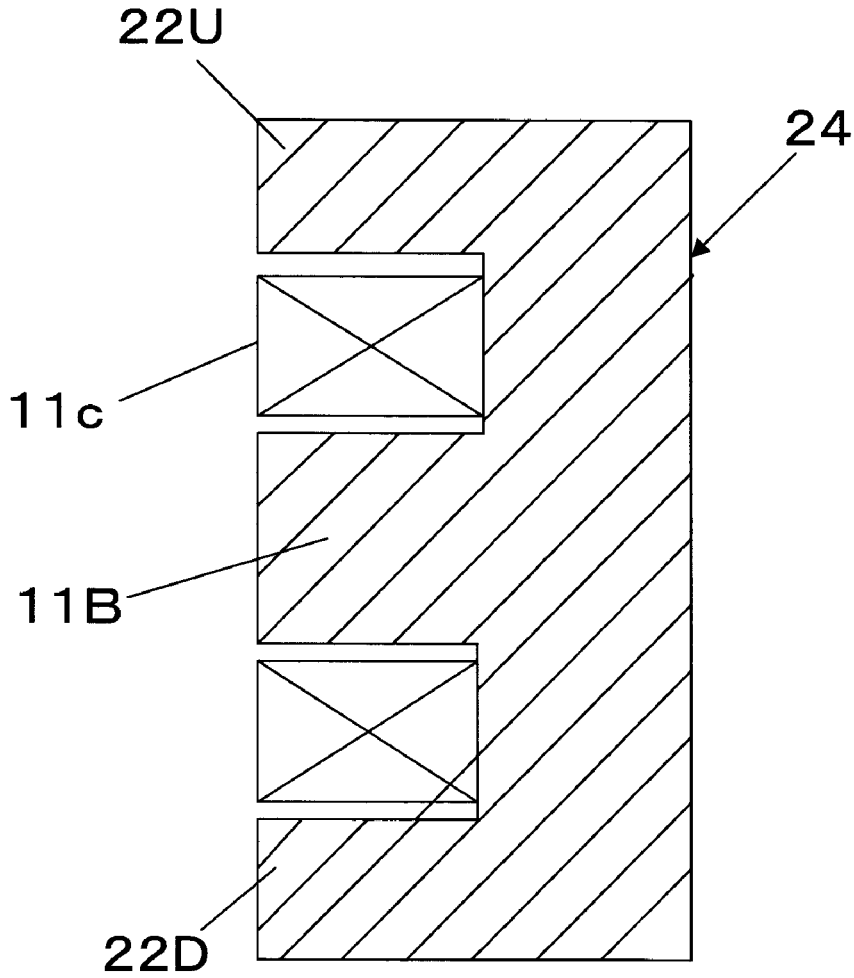
FIG. 7 is a partial diagram showing aspects of the configuration of the integrated sensor body.
Figure 8:
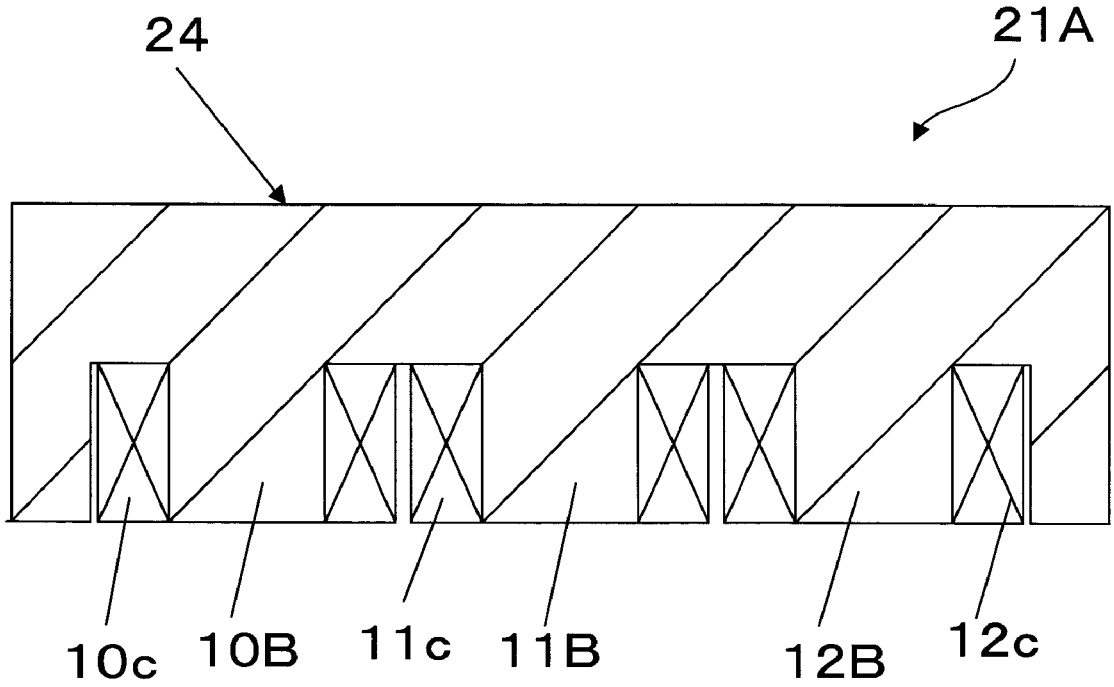
FIG. 8 is a partial diagram showing aspects of the configuration of the integrated sensor body.

In the present invention, three sensors aligned on the same face side of the coin path 4, for example the sensors 10, 11 and 12, are integrally aligned laterally in a row to form a rectangular integrated sensor body 21A. Next, the structure of the integrated sensor body 21A will be explained. Incidentally, since each sensor has the same structure, the same portions of the sensors are attached with reference numerals indicating individual sensors and the same alphabet for the explanation thereof. As shown in FIGS. 4, 5, 6 and the like, the integrated sensor body 21A extends horizontally along the coin path 4, and has a rectangular core main body 24 formed with a ferromagnetic material such as ferrite. Three cores 10B, 11B and 12B rectangular in cross section are formed, in a protruding manner relative to the core main body 24, at regular intervals on a central position line of the core main body 24 in a longitudinal direction thereof. That is, as shown in FIG. 5, the core 11B is positioned at a central position of the core main body 24, and the cores 10B and 12B are disposed on the left and right of the core 11B away from the core 11B by the same distance D. The sensor coils 10*c*, 11*c* and 12*c* (hereinafter "coils") are wound around the cores 10B, 11B and 12B, respectively. Thereby, the three sensors 10, 11 and 12 are formed for discriminating a disk such as a coin. The core 10B of the left end sensor 10 is closely wound with a copper wire to form a rectangular coil 10*c*. The coil may be formed into a round shape like a conventional manner, but a structure in which a coil fits an outer periphery of a core is more efficient in magnetic flux generation. Similarly, the core 12B of the right end sensor 12 is closely wound with a copper wire to form a rectangular coil 12*c*. Similarly, the core 11B of the sensor 11 positioned at a center is also closely wound with a copper wire to form a rectangular coil 11*c*.

Further, upper and lower core walls 22U and 22D are integrally formed in the core main body 24, protruding to the same level as the cores 10B, 11B and 12B, so that a periphery of the core main body 24 is almost entirely surrounded by the upper and lower core walls. A magnetic flux path is formed by the upper and lower core walls 22U and 22D and the cores 10B, 11B and 12B.

After the coils 10*c*, 11*c* and 12*c* are formed on the cores 10B, 11B and 12B in a winding manner, an adhesive agent 29 is applied into spaces among the coils 10*c*, 11*c* and 12*c* and spaces between the respective coils and the peripheral portion of the core main body 24. The adjacent coils 10*c*, 11*c* and 12*c* are then bound and solidified by the adhesive agent. Thereby, such a structure is completed that the three sensors 10, 11 and 12 are laterally arranged in alignment and integrally fixed. In this manner, the integrated sensor body 21A is formed. The integrated sensor body 21A is a coin identifying sensor. Two integrated sensor bodies with the above configuration are prepared and disposed opposite to each other across the coin path 4. That is, as shown in FIG. 3, one integrated sensor body 21A is fixed in a state in which the core main body 24 abuts on the front side plate 5*a* so that end faces of the cores 10B, 11B and 12B face the coin path 4. Mounting and fixing to the side plate 5*a* can be performed by such a method that a back face of the core main body 24 is adhered and fixed on the side plate 5*a* by an adhesive agent. Next, the other integrated sensor body 21B is fixedly disposed in a state of abutting on the back side plate 5*b* such that the core main body is disposed symmetrically to the core main body 24 of the integrated sensor body 21A through the coin path 4. Thereby, a first coin detecting section 25X is formed at an upper position of the coin path 4 by the integrated sensor bodies 21A and 21B facing each other. In this manner, one coin detecting section is formed by the integrated sensor bodies 21A and 21B which are two coin identifying sensors. The coin detecting section serves as a coin identifying apparatus.

The left end sensors 10, 13 and the right end sensors 12, 15 of the first coin detecting section 25X detect fluctuation of oscillation output based upon a relative area between left and right end portions of a coin passing through and the sensors. Since the relative area varies according to a size of a coin, a diameter of a coin can be detected based upon the fluctuation of the oscillation output. Therefore, the left end sensors 10, 13 and the right end sensors 12, 15 serve as a first diameter detection sensor 19. The central sensors 11 and 14 of the first coin detecting section 25X serve as a third sensor, or a material sensor 17, and detect fluctuation of oscillation output generated due to a fluctuation of the magnetic flux caused by the passage of a coin. Since the oscillation output is influenced by a material of the coin C, a material thereof is detected by utilizing this influence.

Similarly, the other pair of integrated sensor bodies 21C and 21D is disposed opposite to each other across the coin path 4 below the first coin detecting section 25X to form a second coin detecting section 25Z. In the second coin detecting section 25Z, a left end sensor 36 is composed of sensors 30 and 33 which detect a relative area between the sensors and a left end portion of a coin, and a right end sensor 38 is composed of sensors 32 and 35 which detect a relative area between the sensors and a right end portion of a coin. The left end sensor 37 and the right end sensor 38 comprise a second diameter detection sensor 39 which can detect fluctuation of oscillation output generated due to a difference in relative area between the left and right ends and the sensors varying according to a size of a coin passing through similarly as described above. Further, the sensors 31 and 34 serve as a fourth sensor, or a thickness sensor 37, and detect fluctuation of oscillation output generated due to magnetic flux fluctuation caused by the passage of the coin C. Since the oscillation output is influenced by a thickness of a coin to fluctuate, a thickness thereof is detected by utilizing this influence. Therefore, the first coin detecting section 25X composed of the upper pair of integrated sensor bodies 21A and 21B mainly relates to detection of a material and is secondarily provided for detection relating to diameter detection, while the second coin detecting section 25Z composed of the lower pair of integrated sensor bodies 21C and 21D is provided for detection of both a diameter and thickness. Incidentally, a case is explained in the embodiment, in which the central sensors 11 and 14 of the first coin detecting section 25X positioned above detect a material and in which the central sensors 31 and 34 of the second coin detecting section 25Z positioned below detect a thickness. Such a case may be however adopted that the detection order is reversed, that is, the central sensors of the first coin detecting section first detect a thickness and then the central sensors of the second coin detecting section detect a material. More specifically, such a configuration may be adopted that the positions of the first and second coin detecting sections 25X and 25Z are interchanged. Further, since the first and second coin detecting sections do not necessarily correspond to each other in a positional relationship, it is obvious that the coin detecting section positioned below may serve as a first coin detecting section and the coin detecting section positioned above may serve as a second coin detecting section.

Figure 9:
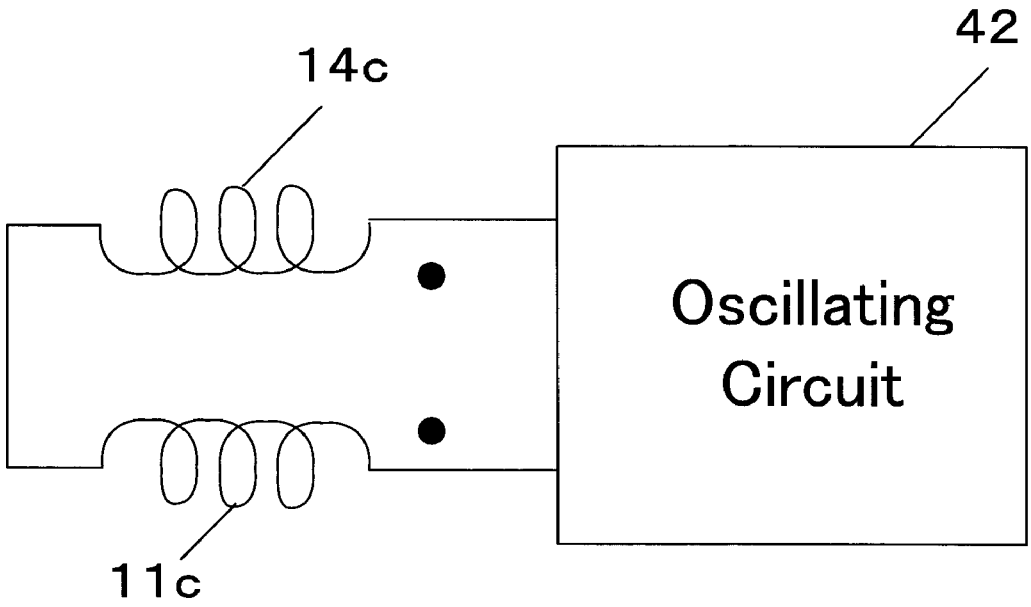
FIG. 9 is a connecting circuit diagrams of coils of coin sensors.

Next, the connections of coils in the upper first coin detecting section 25X will be explained. As shown in FIGS. 3 and 9, a winding start of the coil 14*c* in the material sensor 17 is connected to an oscillating circuit 42. The oscillating circuit 42 is connected to a detecting and rectifying circuit 46. The winding start is shown by black circle in FIG. 9. A winding end of the coil 14*c* is connected to the winding end of the coil 11*c*, the winding starts of the coils 14*c* and 11*c* are both connected to the oscillating circuit 42. The coils 11*c* and 14*c* are connected in a cumulative connection manner in which a magnetic flux favorable to material detection can be generated toward the front and back side plates 5*a* and 5*b* across the coin path 4.

Figure 11:
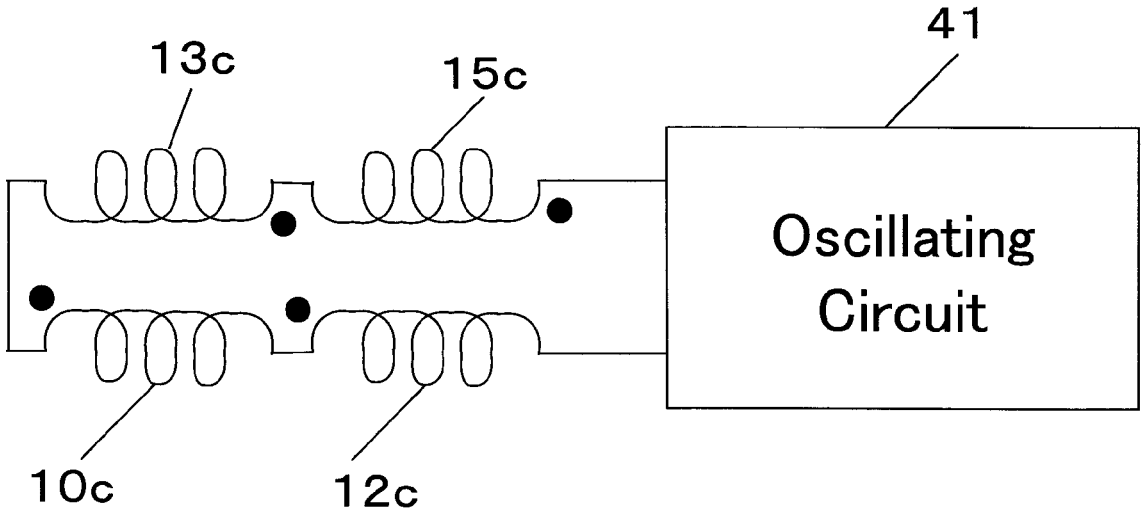
FIG. 11 is another connecting circuit diagrams of coils of coin sensors.

On the other hand, as shown in FIG. 11, a winding start of the coil 15*c* in the first diameter detection sensor 19 is connected to an oscillating circuit 41, and the oscillating circuit 41 is connected to a detecting and rectifying circuit 45. The winding end of the coil 15*c* is connected to a winding start of the coil 13*c*. The winding end of the coil 13*c* is connected to a winding start of the coil 10*c*, and a winding end of the coil 10*c* is connected to a winding start of the coil 12*c*. A winding end of the coil 12*c* is connected to the oscillating circuit 41. In this connection, the coils 13*c* and 15*c* and the coils 10*c* and 12*c*, which are serially connected, are disposed opposite to each other across the coin path 4 and connected in a differential connection manner to detect a diameter. A cumulative connection is favorable to diameter detection, but since the central material sensor 17 is applied with a cumulative connection, the coils 10*c* and 12*c* and the coils 13*c* and 15*c* which are adjacent to the left and right of the material sensor 17 respectively are connected in a differential connection manner in order to avoid interference.

Figure 10:
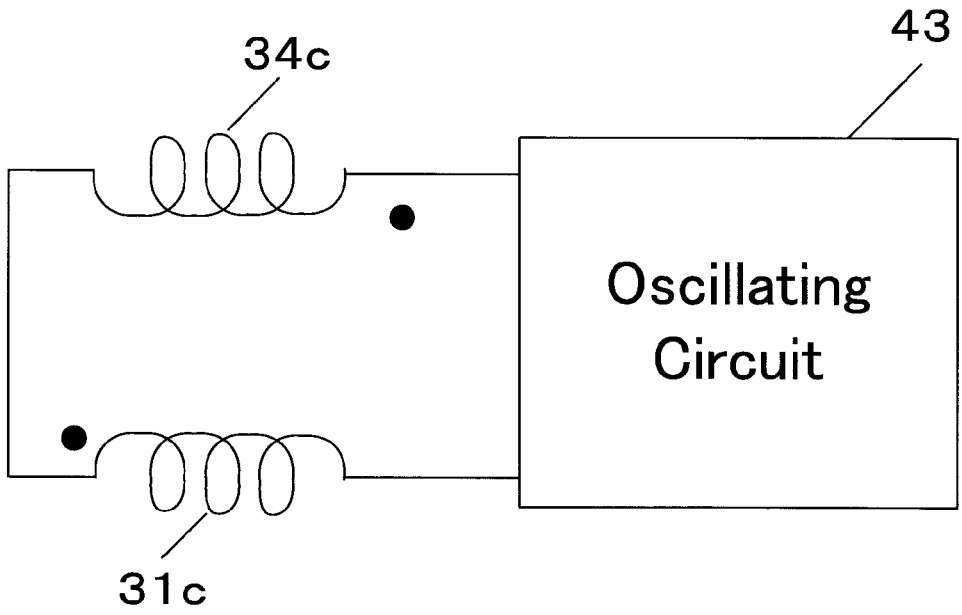
FIG. 10 is another connecting circuit diagrams of coils of coin sensors.

The connection of coils in the lower second coin detecting section 25Z will be explained. As shown in FIG. 10, a winding start of a coil 34*c* in the thickness sensor 37 is connected to an oscillating circuit 43. The oscillating circuit 43 is connected to a detecting and rectifying circuit 47. A winding end of the coil 34*c* is connected to a winding start of a coil 31*c*, and a winding end of the coil 31*c* is connected to the oscillating circuit 43. The coils 31*c* and 34*c* are connected in a differential connection manner which a magnetic flux favorable to thickness detection can be generated in a vertical direction along the coin path 4.

Figure 13:
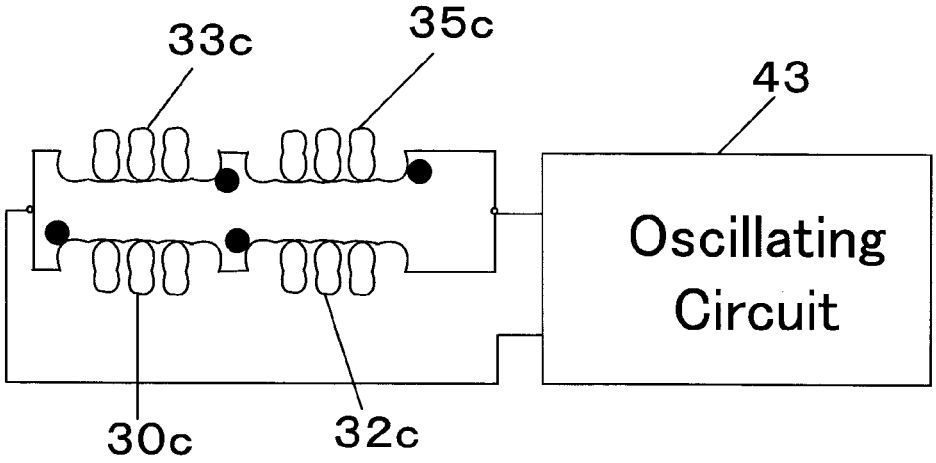
FIG. 13 is a diagram for explaining that a coin passing through a coin path in a biased manner is detected inaccurately in the case of a conventional coil connection method.
Figure 14:
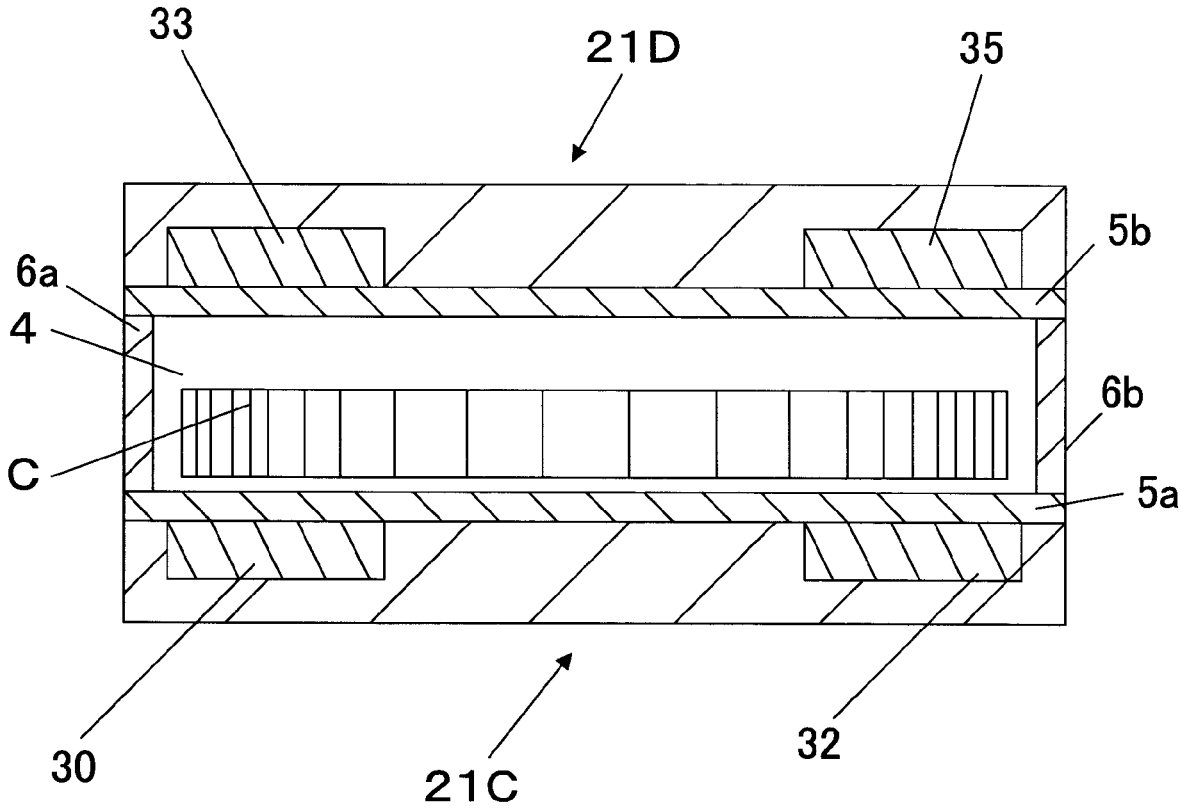
FIG. 14 is a view for explaining in cooperation with FIG. 13, that a coin passing through a coin path in a biased manner is detected inaccurately in the case of a conventional coil connection method.

The coils 30*c* and 33*c* of the left end sensor 36 and the coils 32*c* and 35*c* of the right end sensor 38 in the second diameter detection sensor 39 are connected in a cumulative connection manner in which a magnetic flux favorable to diameter detection can be sufficiently generated across the coin path 4. In this case, the following concern is evident in such a circuit as shown in FIG. 13 in which the coils 30*c* and 32*c* on the front of the coin path 4 and the coils 33*c* and 35*c* on the back thereof are simply connected in series-parallel. If the coin C passes through the coin path 4 in such a state as shown in FIG. 14 in which the coin C is biased to either one of the front and back side plates, for example to the front side plate 5*a*, the sensors 30 and 32 near the coin C become high-responsive. To the contrary, the sensors 33 and 35 far from the coin C become slow to response. Therefore, at a time of biased passage of a coin in this way, responsiveness of the sensors is biased as compared to a case that the coin C passes through the center of the coin path 4, so that detection output fluctuates.

Figure 12:
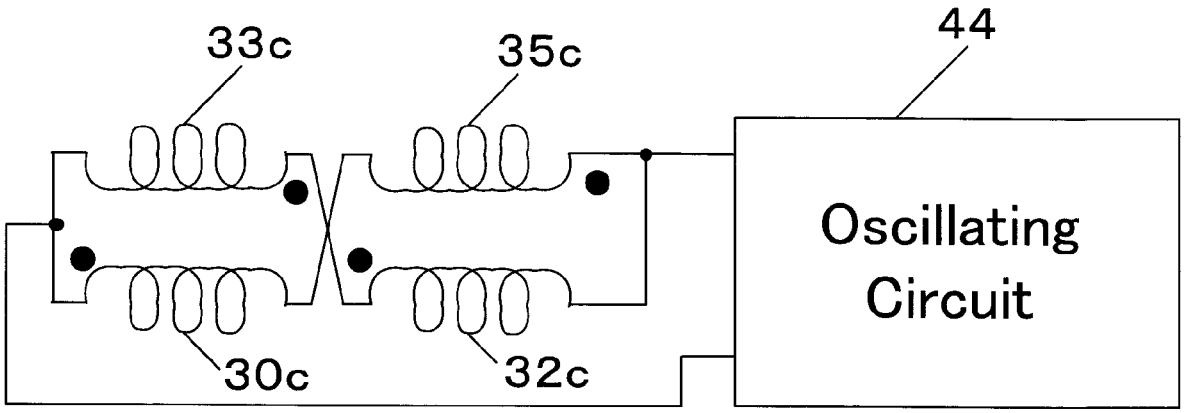
FIG. 12 is another connecting circuit diagrams of coils of coin sensors.

As shown in FIG. 12, the coils 30*c* and 33*c* of the left end sensor 36 and the coils 32*c* and 35*c* of the right end sensor 38 are connected so that the two coils positioned diagonally opposite across the coin path, namely, the coils 30*c* and 35*c* and the coils 33*c* and 32*c* are serially connected to each other, and that output imbalance between the left end sensor 36 and the right end sensor 38, if any, is cancelled. That is, the winding end of the coil 30*c* of the left end sensor 36 on the front side of the coin path 4 is connected to the winding end of the coil 35*c* of the right end sensor 38 on the back side thereof. Similarly, the winding start of the coil 33*c* of the left end sensor 36 on the back side of the coin path 4 is connected to the winding start of the coil 32*c* of the right end sensor 38 on the front side thereof. The winding start of the coil 30*c* and the winding end of the coil 33*c* of the left end sensor are connected to each other in a common connection manner to be connected to an oscillating circuit 44, while the winding end of the coil 32*c* and the winding start of the coil 35*c* of the right end sensor 38 are connected to each other in a common connection manner to be connected to the oscillating circuit 44. The oscillating circuit 44 is connected to a detecting and rectifying circuit 48.

In such a coil connection method, even if the coil 30*c* of the left end sensor 30 and the coil 32*c* of the right end sensor 32 respond strongly due to the passage of a coin biased to the side plate 5*a* as shown in FIG. 14, the coils 30*c* and 32*c* are respectively connected in series to the coil 35*c* of the right end sensor 35 and the coil 33*c* of the left end sensor 33 which are positioned on the opposite side where responsiveness is reduced, so that total responsiveness is averaged. Therefore, detection output fluctuation caused by the difference in pass-through position of a coin can be reduced, so that detection can be performed well and in a stable manner. The second diameter detection sensor 39 is composed of the left end sensor 36 and the right end sensor 38 connected in this manner. As a result, a magnetic flux toward either one of the front and back side plates 5*a* and 5*b* across the coin path 4 is sufficiently generated between the coils 30*c* and 32*c* and the coils 33*c* and 35*c* which are relatively arranged, so that a diameter of the coin C can be detected with high accuracy.

The oscillating circuit 42 connected to the material sensor 17 (11, 14) is connected to the detecting and rectifying circuit 46. The oscillating circuit 43 connected to the thickness sensor 37 (31, 34) is connected to the detecting and rectifying circuit 47. The oscillating circuit 41 connected to the first diameter detection sensor 19 (10, 13, 12, 15) is connected to the detecting and rectifying circuit 45. The oscillating circuit 44 connected to the second diameter detection sensor 39 (30, 33, 32, 35) is connected to the detecting and rectifying circuit 48. The respective detecting and rectifying circuits 45, 46, 47 and 48 are connected to a microprocessor 56 serving as a control circuit via A/D converter circuits 49, 50, 51, and 52. Reference numeral 54 denotes a cancel plate (see FIG. 1) disposed obliquely on the coin path 4. In a case where the cancel plate 54 protrudes on an extension of the coin path 4, the coin C is led to the cancel plate 54 and returned to a return opening (not shown) via the return path 60. The cancel plate 54 is generally pushed by a spring (not shown) to protrude on an extension of the coin path 4. However, when a coin is determined to be real and a solenoid 55 is exited by a signal of the microprocessor 56, the cancel plate 54 is deviated from the extension of the coin path 4. Then, the coin C drops vertically to be guided to a retaining portion (not shown) via a receiving path 61. Reference numeral 53 denotes a memory of the microprocessor 56.

Figure 15:
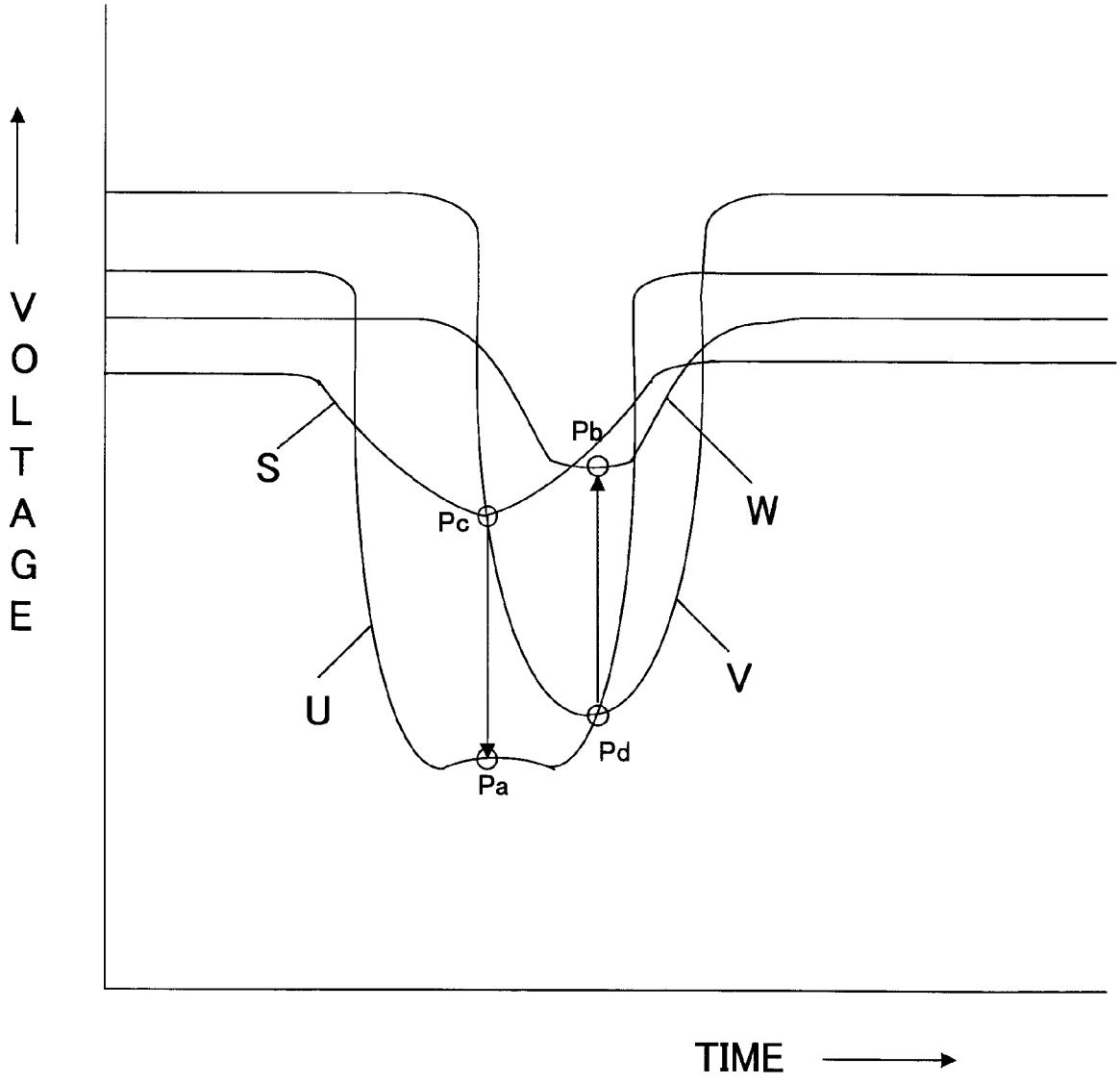
FIG. 15 is a voltage graph chart relating to diameter, material and thickness when a coin is detected by the coin detecting apparatus.

When a coin C is dropped in the coin selector having the above structure, the coin is detected in the course of it dropping through the coin path 4 by the two upper and lower first and second coin detecting sections 25X and 25Z, and a voltage output as shown in FIG. 15 is provided sequentially via the respective detecting and rectifying circuits. FIG. 15 shows voltage waveforms reflecting a diameter, material and thickness of a certain gold type of a coin when the coin singularly drops through the coin path 4. A waveform S is an output value obtained when a diameter is detected by the first diameter detection sensor 19 of the first coin detecting section 25 X and when the detection output thereof is detected and rectified by the detecting and rectifying circuit 45. A waveform U is an output value obtained when a material is detected by the material sensor 17 of the first coin detecting section 25X and when the detection output thereof is detected and rectified by the detecting and rectifying circuit 46. A waveform V is an output value obtained when a diameter is detected by the second diameter detection sensor 39 of the second coin detecting section 25Z, where the coin next passes through, and when the detection output thereof is detected and rectified by the detecting and rectifying circuit 48. A waveform W is an output value obtained when a thickness is detected by the thickness sensor 37 of the second coin detecting section 25Z, where the coin next passes through, and when the detection output thereof is detected and rectified by the detecting and rectifying circuit 47. There is a peak value Pc in the waveform S showing diameter data. The waveform S shows that the output gradually varies as the coin C approaches the first diameter detection sensor 19 and reaches the maximum to be a peak value Pc at a point where the diametrical portion (center) of the coin C just passes through the sensor 19, and that the output then gradually varies less significantly as the coin C moves away from the sensor 19 and returns to a voltage value obtained when no coin passes through. Therefore, the peak value Pc is a detected value corresponding to the diameter of the coin C, and can be used for diameter discrimination.

When passing through the first coin detecting section 25X, the coin C, which causes the first diameter detection sensor 19 to output the waveform S, then reaches the second coin detecting section 25Z below and passes through the section in a dropping manner, so that the coin C is detected by the second coin detecting section 25Z at this time. There is also a similar peak value Pd in the waveform V showing diameter data thus detected. In this case, the waveform V also shows that similar output variation occurs in the course of approach and passage of the coin C to the second diameter detection sensor 39, and that the peak value Pd is obtained at a point where the diametrical portion (center) of the coin C faces the sensor 39. Therefore, the peak value Pd is a detected value corresponding to the diameter of the coin C, and can be used for diameter discrimination. In this case, the output fluctuation is larger in the waveform V than in the waveform S. This is because the flux content varying (cut) due to passage of a coin is larger and a larger detection output can be obtained in the second diameter detection sensor 39 having the coils 30*c*, 32*c*, 33*c* and 35*c* in cumulative connection which allows magnetic fluxes favorable to diameter detection to be generated in the same direction so that a flux content can be increased, compared to the first diameter detection sensor 19 having the coils 10*c*, 12*c*, 13*c* and 15*c* in differential connection which magnetic fluxes to be generated in directions opposite to each other so that a flux content is reduced. It is eventually shown that the left and right end sensors 36 and 38 of the second coin detecting section 25Z are strongly involved in diameter detection.

On the other hand, in the waveform U showing material data, there is an approximately constant output during a certain time period when the coin C passes through the material sensor 17. Therefore, it is conceivable that a certain voltage value at a certain point during output variation is picked up as material data, but arbitrary pickup is inadvisable because it may result in unstable detection. Therefore, the detection timing is determined in associating with the diameter detection waveform S of the first diameter detection sensor 19, and a voltage value at that point is picked up. That is, as shown in FIG. 15, a voltage value Pa at a point where the diameter detection waveform S reaches the peak value Pc is obtained from the waveform U. When the waveform S reaches the peak value Pc, the center of the coin C faces the first diameter detection sensor 19. Therefore, the voltage value Pa of the waveform U corresponding to the peak value Pc is a detected value at an optimal point where the center of the coin C and the material sensor 17 face each other so that material data is picked up widely, and hence more than fully reflects the material. Thus, the voltage value Pa is utilized for material discrimination.

In the detection of the peak value Pc showing diameter data applied to the detection of material data, data values of the waveform S are sequentially detected to be updated and stored. Data values are compared with each other before and after updating, and the detected data value is updated and stored as long as the value exceeds the data value before updating. That is, in a case of the waveform S, the microprocessor 56 is programmed such that as long as the voltage value of the present detection is lower than the voltage value of the previous detection, the previous voltage value is updated to the present voltage value as new data, and that when the present voltage value exceeds the previous voltage value, making inversion, the previous voltage value is determined as the peak value.

By such a method of detecting material data obtained when the peak value of diameter data is output, material discrimination can be performed in a stable manner and with high accuracy. Further, since the integrated sensor bodies 21A and 21B forming the first coin detecting section 25X have a structure in which the left end sensor 16 and the right end sensor 18, both of which form the first diameter detection sensor 19, and the material sensor 17 are laterally aligned, a diametrical central portion of the coin C simultaneously faces both the first diameter detection sensor 19 and the material sensor 17 in a crossing manner. Therefore, diameter and material can be simultaneously detected, and besides, the diametrical central portion of the coin C can be detected where enough data can be detected as diameter and material data.

In the waveform W showing data relating to thickness, there is approximately constant output fluctuation during a certain time period when the coin C passes through the thickness sensor 37. Such a thickness data detection is performed in a similar manner to the above-described pickup of material data. That is, in this case, the detection timing is determined in association with the diameter detection waveform V of the second diameter detection sensor 39, and a voltage value at the point is picked up. As shown in FIG. 15, a voltage value Pb at a point where the diameter waveform V reaches the peak value Pd is obtained from the waveform W. Also in this case, the center of the coin C also faces the second diameter detection sensor 39 when the waveform V reaches the peak value Pd. Therefore, the voltage value Pb corresponding to the peak value Pd is a detected value at an optimal point where the center of the coin C and the thickness sensor 37 faces each other so that thickness data is picked up widely, and hence more than fully reflects the thickness. Therefore, the voltage value Pb is utilized for thickness discrimination. In this detecting method as well, by utilizing such a structural feature that the left end sensor 36 and the right end sensor 38, both of which form the second diameter detection sensor 39, and the thickness sensor 37 are laterally aligned, the second coin detecting section 25Z can perform detection at a center of the coin C which provides invaluable data as diameter and thickness data.

Thus, the first and second coin detecting sections are disposed sequentially in the movement direction of a coin on the coin path, and a coin is detected based upon a first detection output first outputted by the first coin detecting section and a second detection output next outputted by the second coin detecting section. By such a coin identifying manner that coin detection is performed based upon the first and second detection outputs which are outputted in this order, an illegal operation can be prevented such as a coin hung on a string. That is, when the coin hung on a string is moved vertically such that the coin comes and goes in the identifying apparatus, the order of outputting the first and second detection outputs which are outputted in this order in a case where a coin is normally dropped in is reversed so that detection outputs are outputted first by the second coin detecting section 25Z and then by the second coin detecting section 25X. Thus it can be determined that an illegal coin is dropped in based upon the difference in the output order of the detection outputs, and the use of an illegal coin can be prevented.

The above-described detecting manner in which the material data Pa at the peak Pc of the first diameter detection sensor 19 is picked up and then the thickness data Pb at the peak Pd of the second diameter detection sensor 39 is picked up is effective in detection when coins are sequentially dropped in. Next, an explanation will be made in this respect. When the coins C are dropped in at intervals, the respective sensors respond to each individual coin as shown in FIG. 15, so that a stable single detected voltage waveform is obtained. On the other hand, in a case where the coins C are sequentially dropped in, since the respective sensors 16, 17 and 18 of the first coin detecting section 25X and the respective sensors 36, 37 and 38 of the second coin detecting section 25Z are positioned in a vertical relationship, sensor outputs are influenced by preceding and following coins which are lined up, so that a detected value reflecting one coin cannot be obtained.

Figure 16:
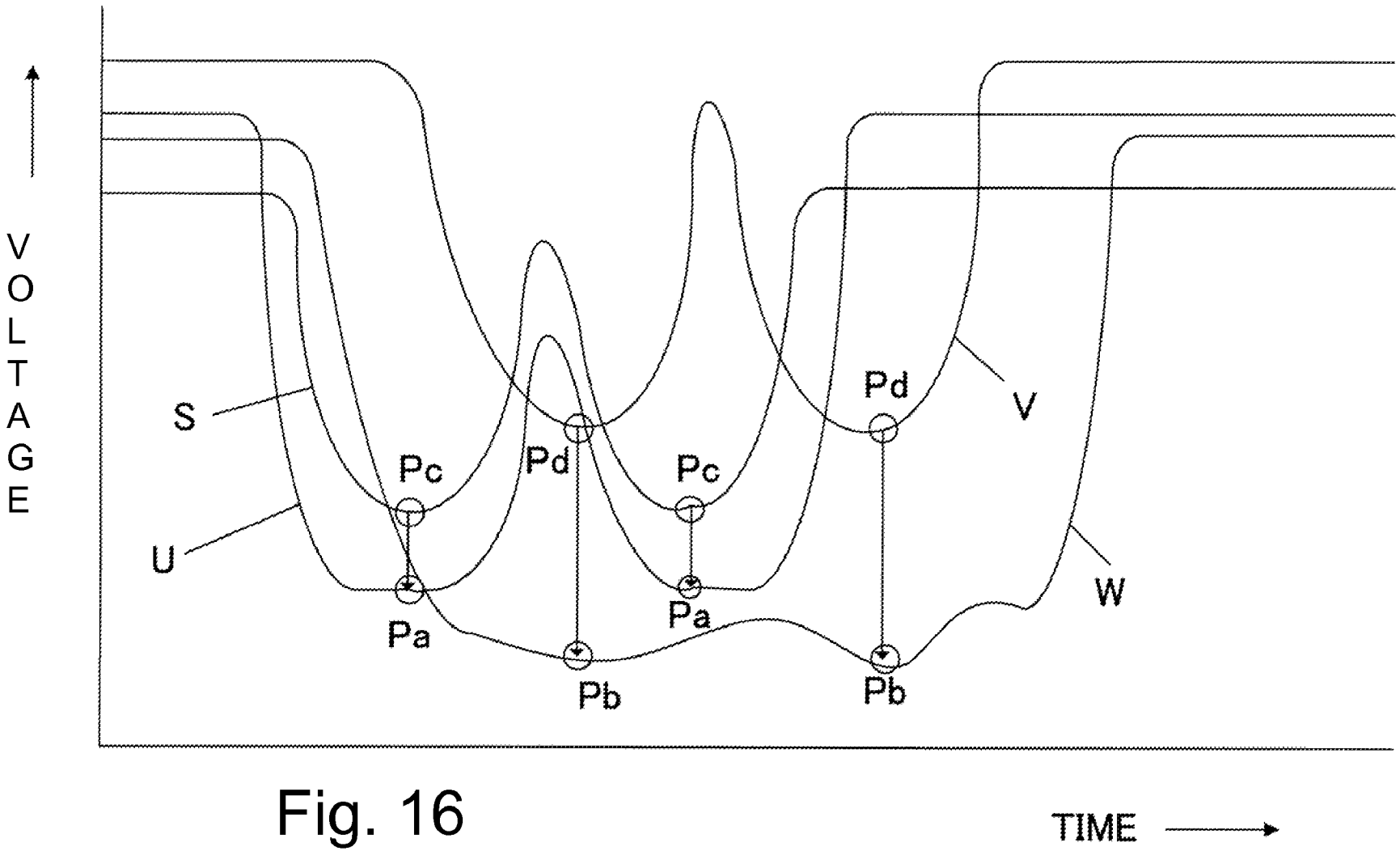
FIG. 16 is a voltage graph chart relating to diameter, material and thickness when coins sequentially dropped in are detected by the detecting apparatus.

FIG. 16 shows voltage outputs in such a case that two coins are sequentially dropped in. A waveform S is a voltage output value obtained when a detection output outputted by the first diameter detection sensor 19 of the first coin detecting section 25X positioned above is detected and rectified. In this waveform, a first peak value Pc corresponding to a diameter of the preceding coin is outputted, and after a while a second peak value Pc corresponding to a diameter of the following coin is outputted. A waveform V is a voltage output value obtained when a detection output outputted by the second diameter detection sensor 39 of the second coin detecting section 25Z positioned below is detected and rectified. Similarly in this waveform, a first peak value Pd corresponding to a diameter of the preceding coin is detected, and after a while a second peak value Pd corresponding to a diameter of the following coin is outputted. A waveform U is a voltage output value obtained when a detection output outputted by the material sensor 17 of the first coin detecting section 25X positioned above is detected and rectified. The waveform is influenced by the coins vertically lined up and shows a voltage output which varies largely during certain earlier and later periods which follows an interval. The waveform W is a voltage output value obtained when a detection output outputted by the thickness sensor 37 of the second coin detecting section 25Z positioned below is detected and rectified. Also in this case, the waveform is strongly influenced by the preceding and following coins and shows a large voltage value and an unstable voltage output fluctuating with short quick steps during a period from the very entrance of the preceding coin into the first coin detecting section 25X to the end of passage of the following coin through the second coin detecting section 25Z.

As can be seen from the waveforms S and V relating to diameter, since two sequential coins are separated from each other except for a contacting portion at which the two coins are in contact with each other, diameter detection is not influenced, so that the left and right end sensors 16 and 18 of the first coin detecting section 25X and the left and right end sensors 36 and 38 of the second coin detecting section 25Z output the outputs Pc and Pd according to diameters of the passing coins in the order of passage of the coins, to detect the diameters. Therefore, the first peak value Pc of the waveform S and the first peak value Pd of the waveform V are picked up as diameter data of the preceding coin. As for the following coin, the second peak value Pc of the waveform S and the second peak value Pd of the waveform V are picked up as diameter data of the following coin.

Material data of the preceding coin is next obtained by picking up a voltage value Pa at the first peak value Pc of the diameter waveform S from the waveform U. Thickness data of the preceding coin is then obtained by picking up a voltage value Pb at the first peak value Pd of the diameter waveform V from the waveform W. Thereby, the respective voltage values Pa and Pb obtained are the values detected when the center of the preceding coin faces the material sensor 17 and the thickness sensor 37, which more than fully reflect the material and thickness and which are effective for discrimination of the material and thickness thereof. In the following coin, material and thickness data is obtained in a similar way. That is, in the waveform U, a voltage value Pa at the second peak value Pc of the diameter waveform S is picked up as material data of the following coin. Similarly in the waveform W, a voltage value Pb at the second peak value Pd of the diameter waveform V is picked up as thickness data of the following coin. The respective voltage values Pa and Pb obtained are sensor detection values at a center of the following coin, which more than fully reflect the material and thickness of the following coin and which are effective for discrimination of the material and thickness thereof. By such a detecting method, diameter, material and thickness data of each of to coins sequentially dropped in can be detected individually to discriminate them.

Even if three or more coins are dropped in sequentially, this detecting method allows diameter, material and thickness data of each of the three coins to be detected individually in the dropping order, so that the sequentially dropped-in coins can be discriminated accurately and in a stable manner.

Next, the operation of the coin selector with the above structure will be explained briefly. In the course of the coin C dropping vertically through the coin path 4 after dropped in, the diameter and material of the coin C are detected by the first coin detecting section 25X, and then the diameter and thickness thereof are detected by the second coin detecting section 25Z. The respective detection outputs of the first diameter detection sensor 19, the material sensor 17, the second diameter detection sensor 39 and the thickness sensor 37 vary the outputs of the respective oscillating circuits 41 to 48, and theses varied outputs are inputted in the respective detecting and rectifying circuits 45 to 48. Voltage outputs relating to diameter, material and thickness thus inputted in the respective detecting and rectifying circuits 45 to 48 are inputted in the respective A/D converter circuits 49 to 52 to be converted to digital values and transmitted to the microprocessor 56. The microprocessor 56 compares the digital values with the preset reference values to determine whether or not the coin has a predetermined diameter, material and thickness, based upon the program stored in the memory 53. As a result of the determination, when the digital values are within the reference values, the coin is judged as real. Then the cancel plate 54 is cleared out of the coin path 4 and the coin is pooled in the retaining portion through the receiving path 61. On the other hand, when the digital values are not within the reference values, the coin is judged as false. Then, the cancel plate 54 remains protruding on the coin path 4, and the false coin is sorted to the return path 60 and returned to the return opening.

While specific embodiments of the invention have been shown and described in detail to illustrate the application of the principles of the invention, it will be understood that the invention may be embodied otherwise without departing from such principles.

APPENDIX

List of Some Reference Numerals

2: coin selector
4: coin path
5*a*, 5*b*: side plate
6*a*, 6*b*: vertical wall
10, 11, 12, 13, 14, 15: coin sensor
10*c*, 11*c*, 12*c*, 13*c*, 14*c*, 15*c*: coil
10B, 11B, 12B, 13B, 14B, 15B: core
17: material sensor
19: first diameter detection sensor
21A, 21B, 21C, 21D: coin identifying sensor
24: core main body
25Z: first coin detecting section
25Z: second coin detecting section
30, 31, 32, 33, 34, 35: coin sensor
30*c*, 31*c*, 32*c*, 33*c*, 34*c*, 35*c*: coil
30B, 31B, 32B, 33B, 34B, 35B: core
37: thickness sensor
39: second diameter detection sensor
C: coin

What is claimed is:

1. A coin identifying sensor comprising:

an integrated sensor body;

a plurality of sensors, each of said sensors having a core wound with a coil, said sensors being integrated in said integrated sensor body with said sensors arranged in a row and fixedly disposed in said sensor body, wherein said integrated sensor body is provided adjacent to a coin path of a coin selector, and disposed in a direction crossing a movement direction of a coin, and the sensor row has three of said sensors aligned laterally, with each of two end sensors positioned corresponding to pass-through positions for both ends of a coin passing through the coin path and a remaining central sensor positioned corresponding to a pass-through position for a center of the coin, wherein the integrated sensor body comprises a core main body with three protruding rectangular cores aligned laterally at intervals and three rectangular coils wound around the respective protruding cores.

2. A coin selector with coin identifying apparatus, the coin selector comprising:

coin selector main body defining a coin path;

a first rectangular coin identifying sensor including a plurality of sensors, each of said sensors having a core wound with a coil, said sensors being integrated in a sensor row the sensor row comprises a core main body with three protruding rectangular cores aligned laterally at intervals and three rectangular coils wound around the respective protruding cores;

a second rectangular coin identifying sensor including a plurality of sensors, each of said sensors having a core wound with a coil, said sensors being integrated in a sensor row the sensor row comprises a core main body with three protruding rectangular cores aligned laterally at intervals and three rectangular coils wound around the respective protruding cores, said first rectangular coin identifying sensor and said second rectangular coin identifying sensor forming a pair of coin identifying sensors with said first rectangular coin identifying sensor disposed opposite said second rectangular coin identifying sensor to form a coin detecting section whereby a coin is detected at the coin detecting section.

3. A coin selector with coin identifying apparatus according to claim 2, further comprising:

another first rectangular coin identifying sensor including a plurality of sensors, each of said sensors having a core wound with a coil, said sensors being integrated in a sensor row the sensor row comprises a core main body with three protruding rectangular cores aligned laterally at intervals and three rectangular coils wound around the respective protruding cores;

another second rectangular coin identifying sensor including a plurality of sensors, each of said sensors having a core wound with a coil, said sensors being integrated in a sensor row the sensor row comprises a core main body with three protruding rectangular cores aligned laterally at intervals and three rectangular coils wound around the respective protruding cores, said another first rectangular coin identifying sensor and said another second rectangular coin identifying sensor forming another pair of coin identifying sensors with said another first rectangular coin identifying sensor disposed opposite said another second rectangular coin identifying sensor to form a second coin detecting section whereby a coin is detected at the second coin detecting section wherein said coin detecting section and said second coin detecting section each sandwich the coin path and are sequentially disposed on the coin path in the movement direction of a coin.

4. A coin selector with coin identifying apparatus according to claim 3, wherein the first coin detecting section and the second coin detecting section are disposed in a vertical relationship on the coin path formed vertically.

5. A coin selector with coin identifying apparatus according to claim 3, wherein the first coin detecting section has a first diameter detection sensor which detects a diameter of a coin by both end sensors positioned corresponding to pass-through positions for both ends of a coin respectively and a material sensor for material detection positioned corresponding to a pass-through position for a center of the coin, while the second coin detecting section has a second diameter detection sensor which detects a diameter of a coin by both end sensors positioned corresponding to pass-through positions for the right and left ends of a coin and a thickness sensor for coin thickness detection positioned corresponding to a pass-through portion for a center of the coin.

6. A coin selector with coin identifying apparatus according to claim 5, wherein a detection output of the material sensor is picked up at the time of output of a diameter data peak value of the first diameter detection sensor, and obtained as material discrimination value data, and a detection output of the thickness sensor is picked up at the time of output of a diameter data peak value of the second diameter detection sensor, and obtained as thickness determination value data, so that whether the coin is real or not is determined based upon these diameter, material and thickness data.

7. A coin selector with coin identifying apparatus according to claim 3, wherein said coin detecting section has a first diameter detection sensor which detects a diameter of a coin by both end sensors of one of said integrated sensor bodies positioned corresponding to pass-through positions for both ends of a coin respectively and a material sensor for material detection positioned corresponding to a pass-through position for a center of the coin, while said another coin detecting section has a second diameter detection sensor which detects a diameter of a coin by both end sensors of one of said integrated sensor bodies positioned corresponding to pass-through positions for the right and left ends of a coin and a thickness sensor for coin thickness detection of one of said integrated sensor bodies positioned corresponding to a pass-through portion for a center of the coin.

8. A coin selector with coin identifying apparatus, the coin selector comprising:

a coin identifying sensor arrangement comprising a core body with a plurality of cores and a plurality of windings to provide a plurality of sensors in an integrated sensor body, each of said sensors including one of said cores wound with one of said coils, said sensors being integrated in said integrated sensor body with said sensors arranged in a row and fixedly disposed in said sensor body; and a coin selector main body defining a coin path, said coin identifying sensor being fixed adjacent to a coin path, wherein said integrated sensor body is disposed in a direction crossing a movement direction of a coin, and the sensor row has three of said sensors aligned laterally, with each of two end sensors positioned corresponding to pass-through positions for each of outer ends of a coin passing through the coin path and a remaining central sensor positioned corresponding to a pass-through position for a center of the coin.

9. A coin selector with coin identifying apparatus according to claim 8, wherein the integrated sensor body comprises a core main body with said cores being rectangular and integrated and extending outwardly and aligned laterally at intervals and said coils comprise three rectangular coils wound around the respective protruding cores.

10. A coin selector with coin identifying apparatus according to claim 9, further comprising:

another coin identifying sensor arrangement comprising another integrated sensor body including a core main body with rectangular cores extending outwardly and aligned laterally at intervals and coils comprising three rectangular coils wound around the respective protruding cores to provide a plurality of sensors, each of said sensors including one of said cores wound with one of said coils, said sensors being arranged in a row and fixedly disposed in said sensor body, said coin identifying sensor arrangement and said another coin identifying sensor arrangement forming a pair of coin identifying sensor arrangements with said coin identifying sensor arrangement disposed opposite said another coin identifying sensor arrangement to form a coin detecting section whereby a coin is detected at the coin detecting section.

11. A coin selector with coin identifying apparatus according to claim 10, further comprising:

another pair of coin identifying sensor arrangements, said another pair of coin identifying sensor arrangements forming another coin detecting section whereby a coin is detected at said another coin detecting section wherein said coin detecting section and said another coin detecting section each sandwich the coin path and are sequentially disposed on the coin path in the movement direction of a coin.

12. A coin selector with coin identifying apparatus according to claim 10, wherein said coin detecting section and said another coin detecting section are disposed in a vertical relationship on the coin path formed vertically.

13. A coin selector with coin identifying apparatus according to claim 12, further comprising a detection circuit with a processor receiving a detection output of the material sensor picked up at the time of output of a diameter data peak value of the first diameter detection sensor, and obtained as material discrimination value data, and a detection output of the thickness sensor picked up at the time of output of a diameter data peak value of the second diameter detection sensor, and obtained as thickness determination value data, so that whether the coin is real or not is determined based upon these diameter, material and thickness data.

* * * * *